United States Patent [19]

Oliver

[11] Patent Number: 4,732,022

[45] **Date of Patent: * Mar. 22, 1988**

[54] KEY FOR AN IMPROVED TWISTING TUMBLER CYLINDER LOCK

[75] Inventor: Roy N. Oliver, Salem, Va.

[73] Assignee: Medeco Security Locks, Inc., Salem, Va.

[ * ] Notice: The portion of the term of this patent subsequent to Jan. 13, 2004 has been disclaimed.

[21] Appl. No.: 918,015

[22] Filed: Oct. 14, 1986

Related U.S. Application Data

[63] Continuation of Ser. No. 756,791, Jul. 19, 1985, Pat. No. 4,635,455.

[51] Int. Cl.[4] ..... E05B 19/04

[52] U.S. Cl. ..... 70/406; 70/364 A

[58] Field of Search ..... 70/362–366, 70/376–378, 392, 406–407, 409, 419–421

[56] References Cited

U.S. PATENT DOCUMENTS

| | | | |
|---|---|---|---|
| Re. 30,198 | 1/1980 | Oliver | 70/364 A |
| 1,384,179 | 7/1921 | Christoph . | |
| 2,064,955 | 12/1936 | Singer . | |
| 2,097,407 | 10/1937 | Spinello | 70/364 A |
| 2,379,040 | 6/1945 | Schori . | |
| 3,287,945 | 11/1966 | Yulkowski . | |
| 3,349,587 | 10/1967 | Keller | 70/358 |
| 3,499,303 | 3/1970 | Spain . | |
| 3,656,328 | 4/1972 | Hughes | 70/364 A |
| 3,722,240 | 3/1973 | Spain | 70/364 A |
| 3,837,197 | 9/1974 | Lopez | 70/364 A |
| 3,987,654 | 10/1976 | Iaccino | 70/364 A |
| 4,098,103 | 7/1978 | Raskevicius | 70/364 A |
| 4,103,526 | 8/1978 | Surko | 70/364 A |
| 4,164,857 | 8/1979 | Genakis | 70/352 |
| 4,208,894 | 6/1980 | Surko | 70/364 A |
| 4,235,086 | 11/1980 | Genakis | 70/364 A |
| 4,325,241 | 4/1982 | Keller | 70/358 |
| 4,424,692 | 1/1984 | Rousseau | 70/378 |

FOREIGN PATENT DOCUMENTS

| | | |
|---|---|---|
| 2546551 | 1/1978 | Fed. Rep. of Germany . |

*Primary Examiner*—Robert L. Wolfe

*Attorney, Agent, or Firm*—Bernard, Rothwell & Brown

[57] ABSTRACT

A key according to the invention includes one or more bits which are offset forwardly or rearwardly of a corresponding tumbler axis of a twisting tumbler lock with dual locking function having tumbler points at tumbler positions selectively offset forwardly or rearwardly and selectively rotatable to different angular positions to create an enormous number of keying combinations.

3 Claims, 11 Drawing Figures

KEY FOR AN IMPROVED TWISTING TUMBLER CYLINDER LOCK

This is a continuation of application Ser. No. 756,791, filed July 19, 1985 and now U.S. Pat. No. 4,635,455.

BACKGROUND OF THE INVENTION

1. Field of the Invention

This invention relates to improvements in cylinder locks and particularly to cylinder locks of the type having reciprocating and rotating tumblers.

2. Background Art

Twisting tumbler locks with dual locking mechanisms are embodied in the famous Medeco® locks manufactured by Medeco Security Locks, Inc. of Salem, Va., and as disclosed, for example, in U.S. Pat. No. Re. 30,198, reissued Jan. 29, 1980, and U.S. Pat. No. 3,722,240 granted Mar. 23, 1973 as well as the millions of Medeco locks made and sold since approximately 1970.

It is highly desirable to have as many key changes as possible for each type of cylinder lock. One of the advantages of the Medeco locks are that they provide a significantly greater number of actual key changes available from that previously known. Although the Medeco locks have been on the market for approximately 16 years, there has been no increase in the number of key changes and it was thought that none could be available.

Another highly desirable feature of a lock is its capability for master keying. One of the principal advantages of the Medeco lock disclosed in U.S. Pat. No. 3,722,240 is its ability to master key. However, it is desired to have even further and greater capability for master-keying.

SUMMARY OF THE INVENTION

This invention relates to improvements in the basic twisting tumbler dual-locking-type of lock cylinder known as a Medeco lock. Such cylinders have a plurality of pin tumblers each with chisel points on the tumbler tips so that the tumblers can be rotated as well as moved axially with a properly bitted key having straight and skew cuts. At each tumbler position the chisel point on the tip of the tumbler can be selectively offset relative to the axis of the tumbler either forward or rearward so as to create three additional potential bitting positions at each tumbler position, thus greatly increasing the bitting and combination possibilities. Moreover, the tumblers, instead of rotating through one predetermined angle in each direction, can be arranged to rotate through two different predetermined angles in each direction, thus creating further possibilities for permutations and combinations and increasing the possible bitting capability.

The key for use in the improved lock has generally V-cut bits which may be either perpendicular or skewed to the plane of the blade, but with the apex of the V either on the tumbler axis or forwardly or rearwardly of the tumbler axis. Master-keying may be provided by placing two such bits close enough to each other at each tumbler position to accommodate either a forward offset or a rearward offset tumbler.

BRIEF DESCRIPTION OF THE PREFERRED EMBODIMENTS

Figure 1:
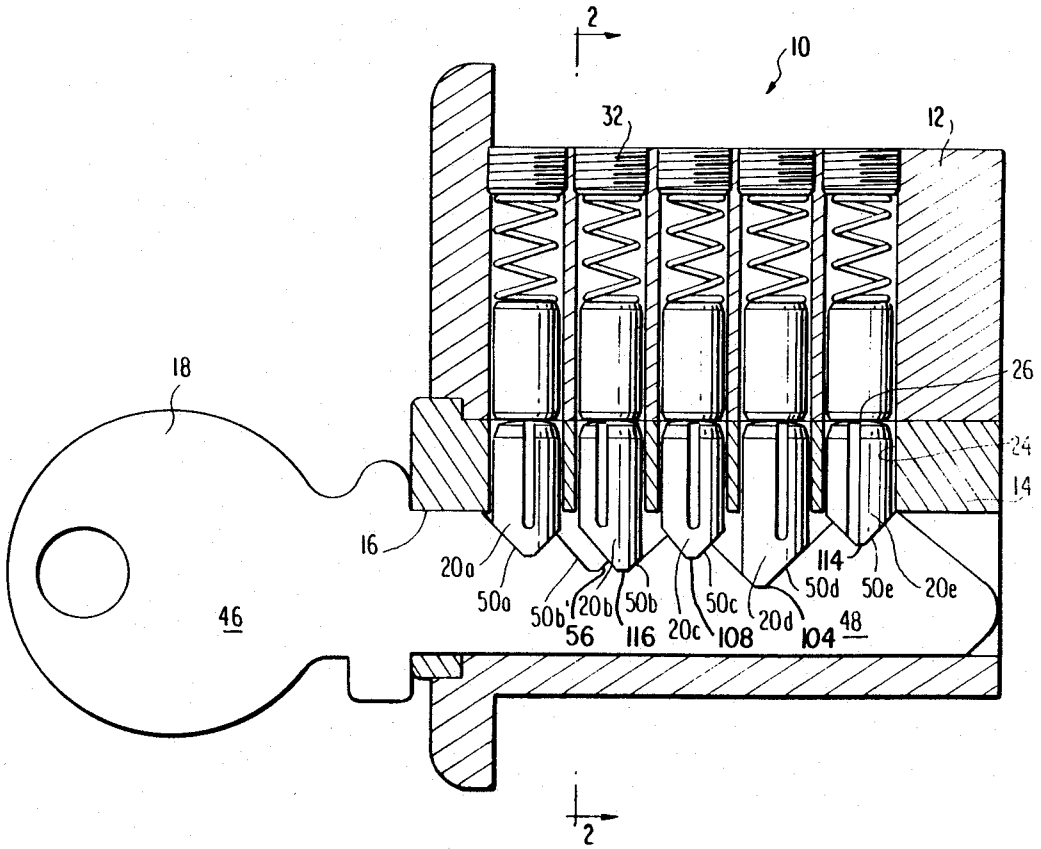
FIG. 1 is a sectional elevation view of an improved cylinder lock according to this invention.

FIG. 1 is a sectional elevation view of a twisting tumbler dual-locking cylinder of the Medeco-type. "Medeco-type" means locks of the type manufactured by Medeco Security Locks, Inc. of Salem, Va., and as shown for example in U.S. Pat. Nos. 3,722,240 and Re. 30,198. As such and in view of the well-known construction of the lock, components which are not changed in this invention from the standard Medeco® lock will not be described in great detail.

With reference to FIG. 1, a cylinder 10 of the Medeco-type has a conventional cylinder shell 12 with a cylinder plug 14 rotatably mounted therein. The cylinder plug has a keyway 16 of desired configuration to accommodate a key 18 having the same sectional configuration as the keyway.

A plurality of reciprocating and rotating tumblers 20 are provided, with one tumbler at each of five tumbler positions for the five pin tumbler lock shown in FIG. 1. Each twisting pin tumber may reciprocate and rotate or oscillate about its longitudinal axis 22 in a corresponding pin tumbler hole 24 in the plug, see FIG. 2. When a properly bitted key is inserted, the tumblers are moved axially until the top of the tumblers are aligned along a shear line 26 tangent to the periphery of the plug. A plurality of drivers 28 are provided, one for each tumbler position, these drivers and tumblers are biased downwardly by springs 30 which abut against screw-threaded spring covers 32 as is known.

Figure 3:
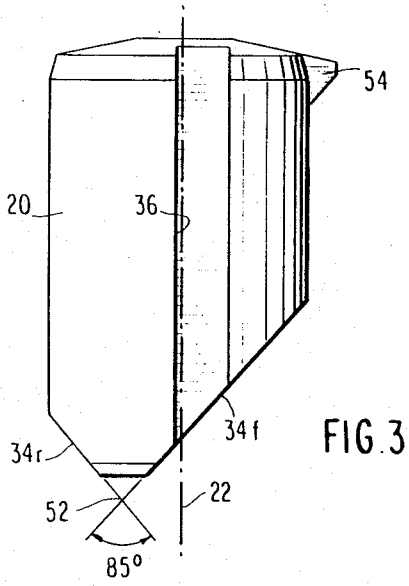
FIG. 3 is an elevation view of an individual tumbler with a rear offset point.
Figure 4B:
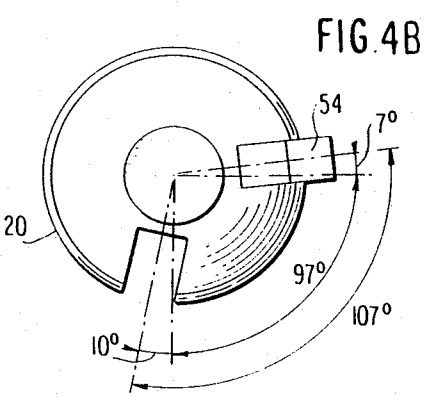
FIG. 4B is a top plan view similar to FIG. 4A, but showing a tumbler for left-hand rotation.
Figure 4A:
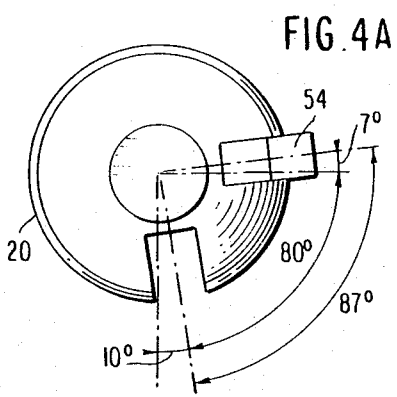
FIG. 4A is a top plan view of the tumbler in FIG. 3 for right-hand rotation.

Each tumbler has on its bottom end a pair of downwardly tapered flat surfaces forming faces 34 of a chisel point. See FIG. 3 showing a rear offset tumbler pin with a long chisel face 34*f* and a short chisel face 34*r*. Other tumbler pins such as tumbler pin 20*c* of FIG. 1 would have chisel faces 34 of equal length, or could be offset forwardly of the tumbler pin axis.

As is known in the Medeco-type lock, each tumbler is provided with a true gate in the form of a slot 36 or equivalent configuration for cooperating with a side bar 38 or other known type of fence means. Springs not shown bias the side bar 38 away from the axis 22 of the tumbler. Thi side bar slides in slot 40. When a properly bitted key causes proper rotation of the tumbler and true gate, the outer edge 44 of the side bar is cammed by cam notch 42 on rotation of the plug 14 as is well known in connection with operation of the Medeco twisting tumbler dual-locking function cylinder lock.

The key 18 has a bow 46 and a blade 48 as is conventional for keys. However, the bitting includes a plurality of bits 50 which are V-shaped and as shown in FIG. 6, the apex of the V for each V-shaped bit at each tumbler position may be either on the center line of the tumbler position or offset forwardly or rearwardly, thus effectively providing three bit positions per tumbler position.

Figure 2:
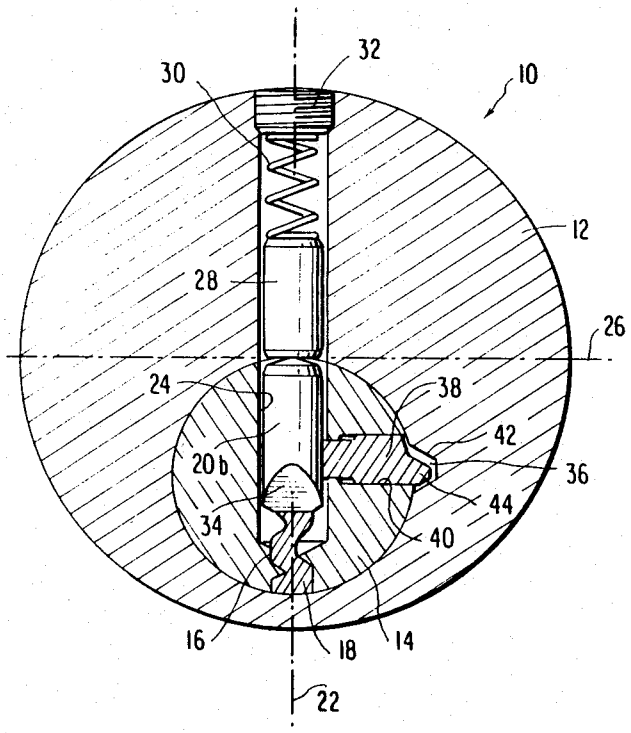
FIG. 2 is a sectional elevation view taken along line 2—2 of FIG. 1.

As is readily apparent from FIG. 2 viewed with reference to FIG. 1, a central longitudinal plane extends longitudinally through key blade 48, which central longitudinal plane passes through tumbler centerline 22 of FIG. 2. The key bits of the blade are defined by generally V-shaped cuts in the key blade which cuts pass through the central longitudinal plane extending through the blade. Each V-shaped cut has an apex, and with reference to both of FIGS. 1 and 6, a distance 100 between an intersection 102 of apex 104 of one V-shaped cut with the central longitudinal plane of key blade 48, and an intersection 106 with the plane of apex 108 of an adjacent V-shaped cut, differs by a predetermined amount from a distance 110 between the apex intersection 102 and an intersection 112 of the apex 114 of another adjacent V-shaped cut. Thus bit 104 is offset toward the key bow of a "normal position" while bit 105 is not offset. Stated another way, each bit of the key is cut relative to a plurality of equally spaced bit centerlines A, with the apex 104 of at least one V-shaped cut of a bit being offset with respect to a corresponding bit centerline A by a predetermined amount. The apex can be offset towards the key bow 46 at a predetermined position A′ relative to A, or can be offset away from the key bow 46 at a predetermined position A″ relative to A. In the embodiment shown in FIG. 1, both apex 104 and apex 116 are offset towards bow 46 and apex 116 being offset away from bow 46. One or more of the V-shaped cuts can be skew cut, and one or more of the V-shaped cuts can be perpendicular relative to the longitudinally extending blade. See FIG. 7.

Figure 6:
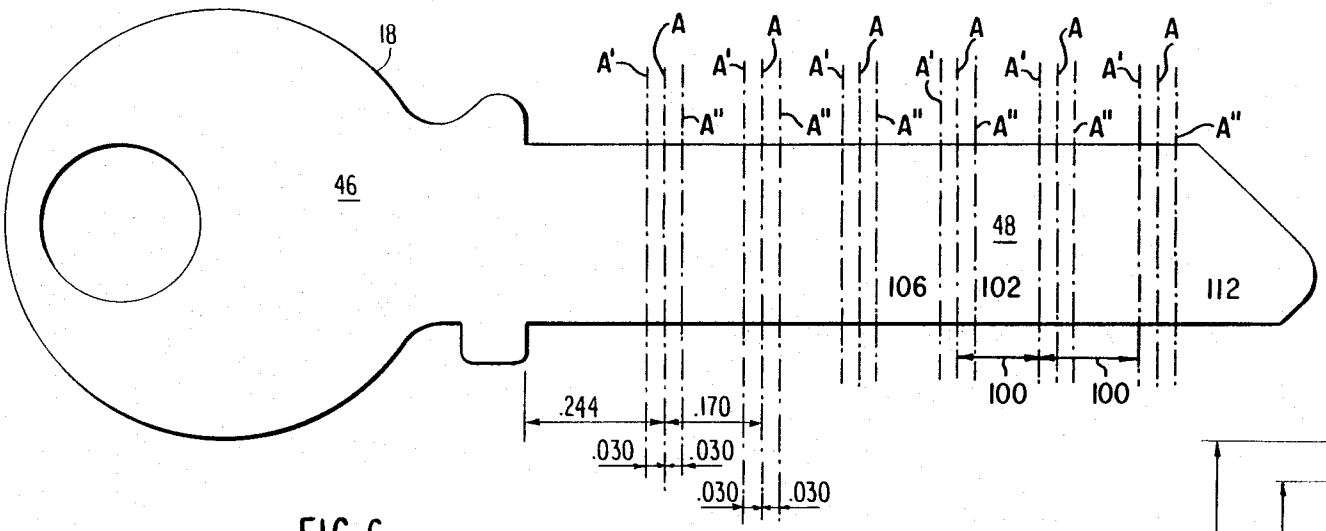
FIG. 6 is a diagrammatic view of a key showing the various possible bitting locations.
Figure 8:
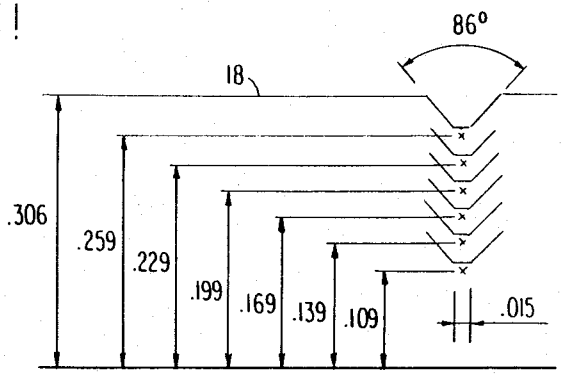
FIG. 8 is a sectional view taken along line 8—8 of FIG. 7.

With reference to FIG. 6, key blade 48 includes a plurality of equally spaced parallel planes that pass through bit centerlines A perpendicular to the longitudinal plane of blade 48 and coinciding with the axes of the equally spaced tumbler pins when the key is inserted into the lock. As shown in FIG. 1, V-shaped key bits 50 of blade 48 complementarily engage each of the equally spaced rotatable tumbler pins 20, each V-shaped bit having an apex for engaging in actuating relationship a corresponding tumbler pin. Referring to FIGS. 1 and 6, the apex of one or more of the V-shaped bits is offset in a direction axially of the blade with respect to one side A′ or the other A″ of one of the equally spaced parallel planes A of blade 48, a predetermined distance less than the opening of a V-shaped bit 50.

Figure 5:
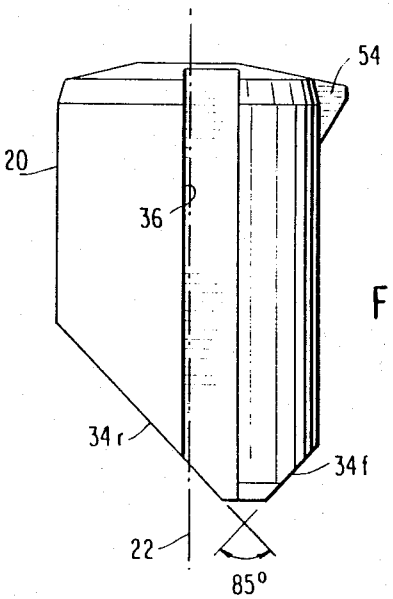
FIG. 5 is an elevation view of a tumbler with a front offset point.
Figure 5B:
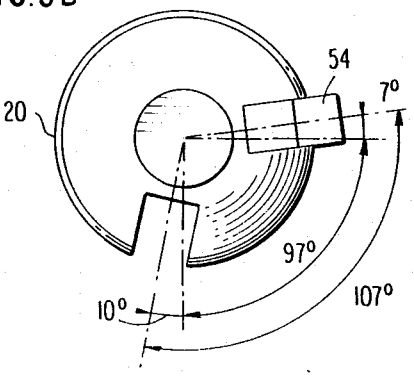
FIG. 5B is a top plan view similar to FIG. 5*a* of a tumbler for left-hand rotation.
Figure 5A:
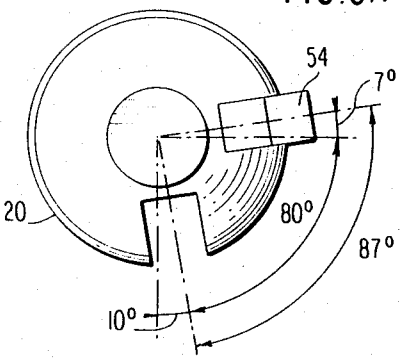
FIG. 5A is a top plan view of the tumbler of FIG. 5 for right-hand rotation.

As shown in FIGS. 3 and 5, an extension of the chisel faces 34 of each tumbler is at a point line 52 and that point line may be offset a predetermined amount from the tumbler center line 22. The offset may be either a rear offset as in FIG. 3 or a forward offset as in FIG. 5. Additionally, there may be no offset, as for example tumblers **20*a* and 20*c* in FIG. 1**.

Figure 7:
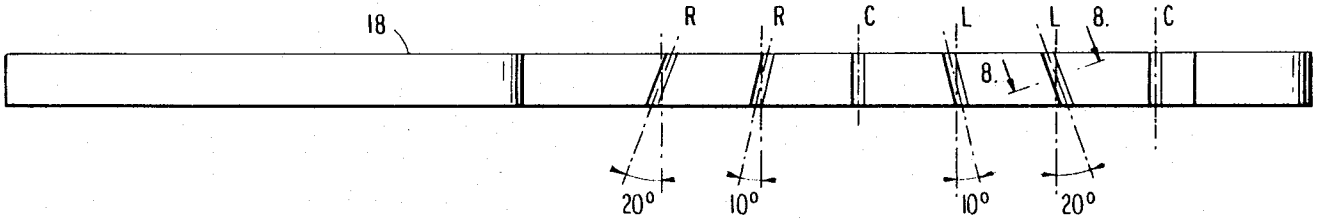
FIG. 7 is a top plan view of the key of FIG. 6.

Additionally, the skew cuts on the key may be either to the left side or right side as indicated L or R in FIG. 7 and may be at different angles, e.g., 10° or 20°, as indicated in FIG. 7. The skew cuts on the key are made to correspond to the rotation of the tumblers. Each tumbler pin has a tang 54 which cooperates with a broached slot (not shown but conventional in Medeco® locks) in the plug 14 and shell 12 to limit total rotation or spin of each tumbler in each direction of rotation to 20°.

By using a tumbler whose chisel point is offset 0.030″ to the front or rear of the centerline of the tumbler in conjunction with locating the side bar slot at either a 10° or a 20° angle from parallel to the chisel point it is possible to manufacture four different and distinct tumblers which are different and distinct from a tumbler whose chisel point is located on the tumbler centerline. All five tumblers may be manufactured so that the direction of the 10° or 20° angle is to the left or to the right of perpendicular to the tumbler's longitudinal axis, thereby enabling the manufacture of ten different and distinct tumblers, and additionally a tumbler whose chisel point is perpendicular to the tumbler's longitudinal axis may be manufactured so that the chisel point is 0.030″ to the front or rear of the centerline of the tumbler or on the centerline of the tumbler, thereby allowing the manufacture of thirteen different and distinct tumblers for each different length of tumbler manufactured. It is possible to manufacture eleven different length useable tumblers with each of these thirteen different tumblers thereby creating one hundred and forty-three different and distinct tumblers. It is also possible to bit a key with a key cut which corresponds directly to one each of these one hundred and forth-three tumblers in each bitting position of the key. Given a key with six bitting positions and considering the above determinations, the theoretical number of different and distinct lock and corresponding key combinations which are possible may be calculated by multiplying 143 to the sixth power which yields an answer of 8,550,986,578,849 theoretically possible key changes.

Moreover, the offset tumblers provide a unique possibility for increasing master key capability. As shown in FIG. 1 for example, at the second pin tumbler position, the key bit is cut offset forwardly at **50*b* but also offset rearwardly at 50*b*′. This leaves a small raised peak 56** which is high enough for either a forwardly offset or a rearwardly offset tumbler chisel face to locate on. With two V-shaped cuts adjacent, the bitting is W-shaped for master-keying in that particular tumbler position.

For example, the use of a tumbler with a chisel point which is offset 0.030″ from the tumbler centerline forces the key cut on the key which corresponds to that tumbler to be positioned 0.030″ to the front or rear of its normal position on the key. This offsetting of the key cut from its normal position makes it possible to bit the key in one bitting position with two different key cuts which may have the same depth dimension or may have depth dimensions which are different by as much as 0.030″ and still operate the tumbler properly. Therefore, it is practical to have a key for a six tumbler lock which has twelve bittings which can be called a master key. This master key may be used to operate as many as sixty-four different cylinders, each of which is operated by a separate and distinct key which will operate only one cylinder, and does not require the use of master or split pins in any cylinder to accomplish this operation. Furthermore, the combination of this master key could only be determined by physically decoding a minimum of seven different cylinders or keys which were produced in sequence. While there are two key cut possibilities for each of the six tumbler positions, there is only one tumbler possibility per position. By multiplying the number of key cuts per position (two) to a power equal to the number of positions (6) the number of possible tumbler combinations (64) is obtained., The above principle combined with a master keying technique which does utilize master or split pins can yield a master key system which is theoretically capable of 18,750 different key combinations for each of the sixty-four tumbler combinations for a theoretical total of 1,200,000 change keys operable by one master key.

While the invention has been described in this preferred embodiment and primarily in reference to the side bar cylinder lock of Medeco U.S. Pat. No. Re 30,198, it is also applicable to the small diameter cylinder lock of Medeco U.S. Pat. No. 3,722,240 and other equivalents as would be apparent to those skilled in the art.

I claim:

1. A key for a pin tumbler lock in which longitudinal axes of all of the tumbler pins are equally spaced, the key having a key blade and a key bow, the blade extending longitudinally from the bow along a longitudinal plane of the key, the blade including means for complementarily engaging a row of equally spaced tumbler pins rotatable about respective equally spaced tumbler pin axes, the blade having a plurality of equally spaced parallel planes for coinciding with the axes of the equally spaced tumbler pins when the key is inserted into the lock, the equally spaced parallel planes being perpendicular to the longitudinal plane of the blade, the pin-engaging means being comprised of a plurality of key bits defined by generally V-shaped cuts in the blade for complementarily engaging each of said equally spaced rotatable tumbler pins, each V-shaped cut having an apex for engaging in actuating relationship a corresponding tumbler pin of said row, the apex of at least one V-shaped cut being offset in a direction axially of the blade with respect to one side or the other of one of the equally spaced parallel planes by a predetermined distance less than the opening of the V-shaped cut, at least one of the V-shaped cuts being skew cut relative to the longitudinally extending blade.

2. The key of claim 1 wherein at least one of said V-shaped cuts is not offset with respect to one of said parallel planes, but is coincident with such parallel plane.

3. The key of claim 1 wherein at least one of the V-shaped cuts is perpendicular relative to the longitudinally extending blade.

* * * * *